US010613482B2

(12) United States Patent
Feyer

(10) Patent No.: US 10,613,482 B2
(45) Date of Patent: Apr. 7, 2020

(54) MECHANISM FOR DISPLAYING A TIME PERIOD OR SEASON

(71) Applicant: Blancpain SA, Le Brassus (CH)

(72) Inventor: Julien Feyer, Vernier (CH)

(73) Assignee: Blancpain SA, Le Brassus (CH)

( * ) Notice: Subject to any disclaimer, the term of this patent is extended or adjusted under 35 U.S.C. 154(b) by 58 days.

(21) Appl. No.: 15/730,888

(22) Filed: Oct. 12, 2017

(65) Prior Publication Data

US 2018/0120771 A1 May 3, 2018

(30) Foreign Application Priority Data

Oct. 27, 2016 (EP) ..... 16195887

(51) Int. Cl.

| | |
|---|---|
| ***G04B 19/253*** | (2006.01) |
| ***G04B 19/243*** | (2006.01) |
| ***G04B 19/26*** | (2006.01) |
| ***G04B 19/04*** | (2006.01) |
| ***G04B 19/08*** | (2006.01) |

(52) U.S. Cl.

CPC ..... *G04B 19/25353* (2013.01); *G04B 19/046* (2013.01); *G04B 19/048* (2013.01); *G04B 19/087* (2013.01); *G04B 19/24306* (2013.01); *G04B 19/26* (2013.01); *G04B 19/262* (2013.01); *G04B 19/268* (2013.01)

(58) Field of Classification Search

CPC .. G04B 19/046; G04B 19/048; G04B 19/087; G04B 19/24306; G04B 19/26; G04B 19/262; G04B 19/268; G04B 45/0023; G04B 45/003

See application file for complete search history.

(56) References Cited

U.S. PATENT DOCUMENTS 245,130 A * 8/1881 Burmann ..... G04B 19/268 368/18
1,997,511 A * 4/1935 Canepa ..... G04B 19/268 368/18

(Continued)

FOREIGN PATENT DOCUMENTS

CH 688171 B5 * 12/1997 ..... G04B 19/268
CN 105334713 A 2/2016

(Continued)

OTHER PUBLICATIONS

European Search Report dated May 17, 2017 in European Application 16195887.1, filed on Oct. 27, 2016 (with English Translation of Categories of cited documents).

(Continued)

*Primary Examiner* — Daniel P Wicklund
(74) *Attorney, Agent, or Firm* — Oblon, McClelland, Maier & Neustadt, L.L.P.

(57) ABSTRACT

A watch includes a timepiece movement including a mechanism for displaying a time period or season which includes a first wheel which is provided in order to turn once in thirty-one days for displaying a day of the month, and a second wheel for displaying another time period or season. The second wheel turns more quickly than the first wheel for displaying this time period or season, and the second wheel is provided in order to be displaced from the first wheel, at the rate of one turn in a period of time between 340 days and 380 days.

15 Claims, 2 Drawing Sheets

(56) References Cited

U.S. PATENT DOCUMENTS 2,764,828 A * 10/1956 Wolaver ..... G04B 19/2536 368/37
3,902,309 A * 9/1975 Torrence ..... G04B 19/262 368/16
4,435,795 A * 3/1984 Frank ..... G04B 19/262 368/16
4,548,512 A * 10/1985 Erard ..... G04B 19/268 368/15
4,711,583 A * 12/1987 Oechslin ..... G04B 19/26 368/16
5,508,979 A * 4/1996 Eisenegger ..... G04B 19/26 368/15
2003/0151981 A1* 8/2003 Vernay ..... G04B 19/2536 368/37
2009/0274010 A1* 11/2009 Vuilleumier ..... G04B 19/26 368/18
2012/0127835 A1 5/2012 Dubugnon et al.
2012/0294125 A1* 11/2012 Laramee ..... G04B 19/262 368/17
2017/0364031 A1* 12/2017 Rochat ..... G04B 19/262

FOREIGN PATENT DOCUMENTS

DE 102008031441 A1 * 1/2010 ..... G04B 19/26
EP 2 428 856 A1 3/2012
WO WO-2012059887 A1 * 5/2012 ..... G04B 19/262

OTHER PUBLICATIONS

Yu FU, et al. "Montre a quantieme septentrional" Journee d'Etude; SwissTech Convention Center, XP055369133, 2014, 6 pages ( with English Abstract).

* cited by examiner

MECHANISM FOR DISPLAYING A TIME PERIOD OR SEASON

This application claims priority from European patent application No. 16195887.1 filed on Oct. 27, 2016, the entire disclosure of which is hereby incorporated herein by reference.

FIELD OF THE INVENTION

The invention relates to a mechanism for displaying a time period or season which is provided in order to cooperate with a timepiece movement, comprising a first wheel provided in order to turn once in thirty-one days for displaying a day of the month, and a second wheel for displaying another time period or season.

The invention also relates to a timepiece movement comprising such a mechanism for displaying a time period or season.

The invention also relates to a watch comprising such a movement.

The invention relates to the field of watch display mechanisms, in particular for complex mechanical watches.

BACKGROUND OF THE INVENTION

Calendar and astronomical displays are functions included in clockmaking, but which complicate manufacture of the movement, and take up a large volume inside the case. Correcting such a display is not always simple.

SUMMARY OF THE INVENTION

The invention proposes to produce a mechanism for displaying a time period or season for a watch, which is simple and economic, with very few components and without any complexity in manufacture.

To this end, the invention relates to a mechanism for displaying a time period or season according to claim 1.

The invention also relates to a timepiece movement comprising such a mechanism for displaying a time period or season.

The invention also relates to a watch comprising such a movement.

BRIEF DESCRIPTION OF THE DRAWINGS

Other features and advantages of the invention will appear upon reading the detailed description which will follow, with reference to the annexed drawings, where.

DETAILED DESCRIPTION OF PREFERRED EMBODIMENTS

Figure 2:
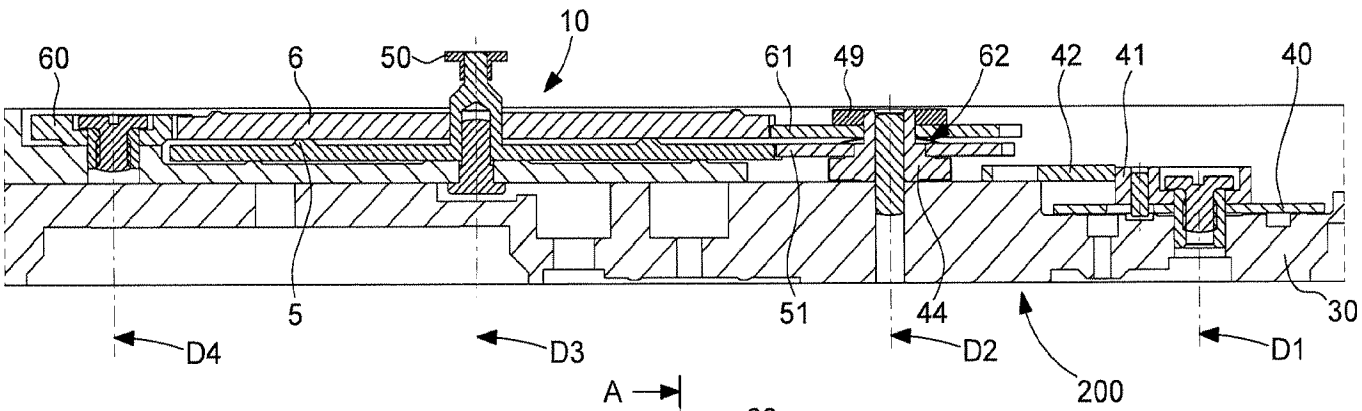
FIG. 2 represents the mechanism of FIG. 1, in section according to a broken line passing through a first axis which is that of the driving wheel, through a driving pin of the cam, through a second axis which is an axis common to the starwheel, to the first lower pinion and to the second upper pinion, through a third axis which is an axis common to the first lower wheel and to the second upper wheel, and through a fourth axis which is the axis of the corrector intermediate wheel.
Figure 1:
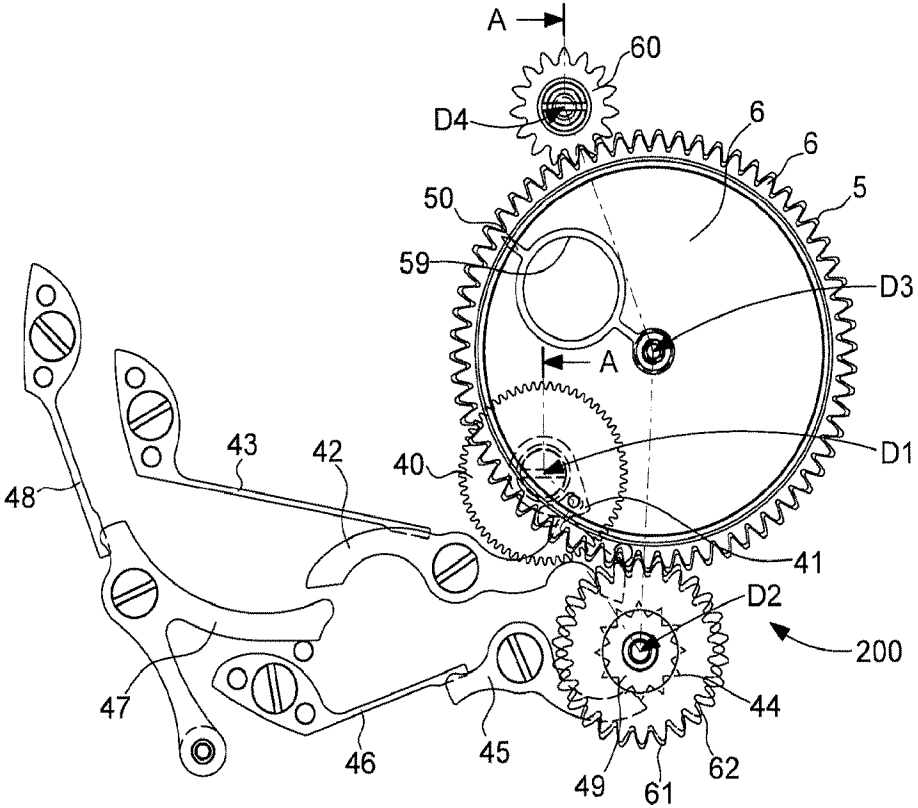
FIG. 1 represents, schematically and in plan view, a mechanism for displaying a time period or season according to the invention, having two coaxial wheels which are superimposed and of a different speed of rotation, a first lower wheel bearing the shaft of a hand, and a second upper wheel surmounted by this hand which turns with the first lower wheel and comprises an opening for displaying a limited zone of the surface of the second upper wheel; the first lower wheel and the second upper wheel cooperate respectively with a first lower pinion and a second upper pinion, the first driven directly, and the second indirectly through friction, by a starwheel, the rotation of which is controlled, from an input driving wheel, via a cam and a driving lever; the position of this driving lever can be modified by action on a corrector lever; the second upper wheel cooperates again tangentially with a corrector intermediate wheel.
Figure 4:
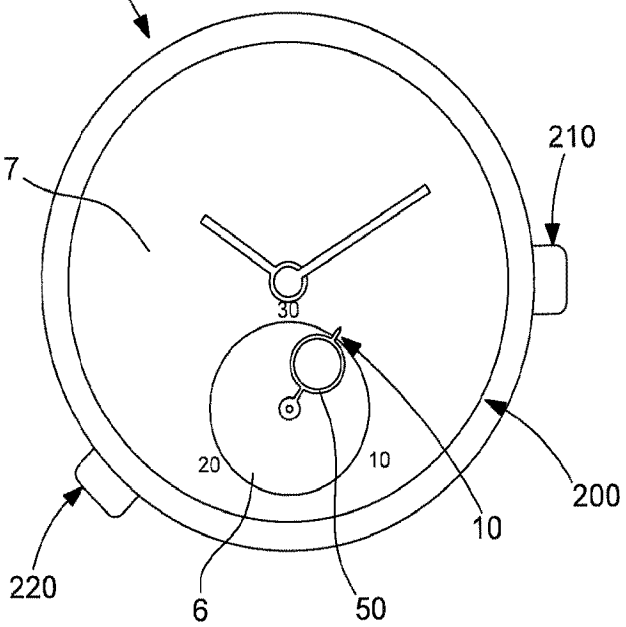
FIG. 4 represents, schematically and in plan view, a watch comprising such a timepiece movement with such a mechanism for displaying a time period or season.
Figure 3:
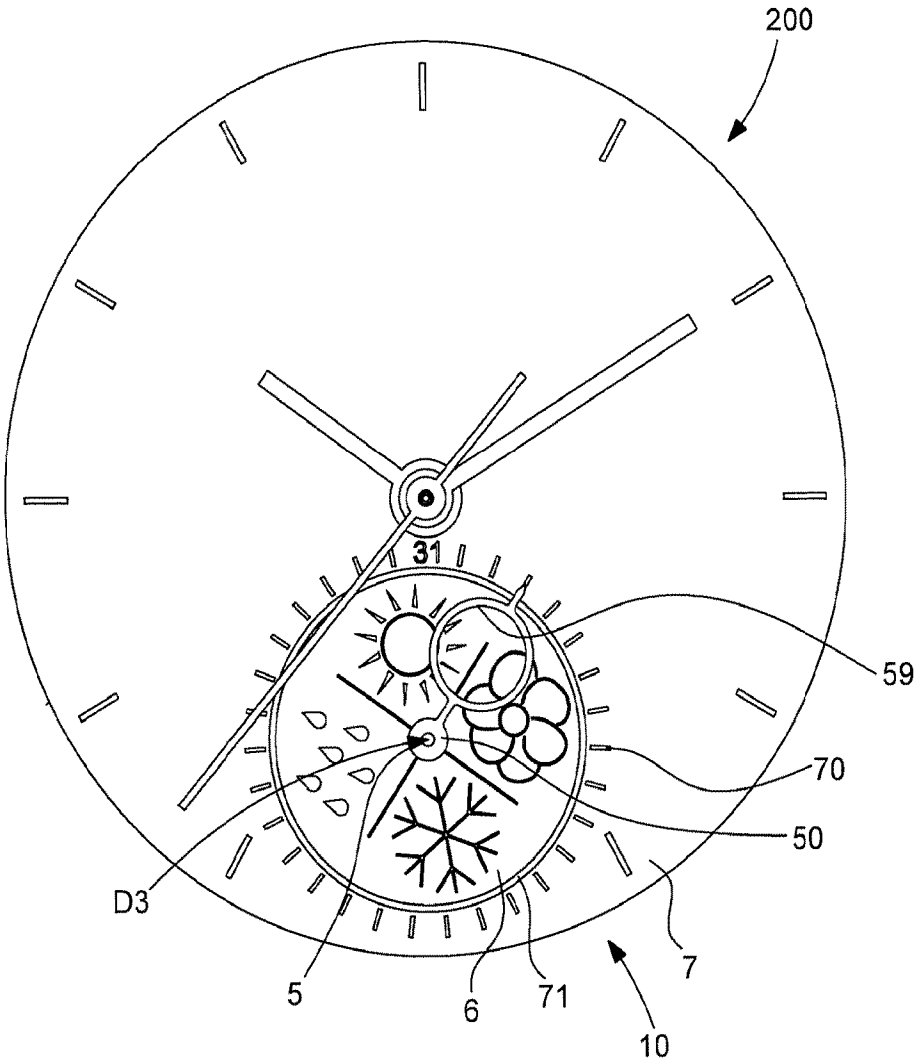
FIG. 3 represents, schematically and in plan view, a movement comprising the mechanism of FIGS. 1 and 2, covered by a dial comprising an aperture which makes the upper surface of the second upper wheel visible, this surface comprising a succession of graphic representations of time periods, here of the four seasons, this dial comprising a display scale which here is the display of the day of the month, with which the end of the hand carried by the first lower wheel cooperates, and a large opening of this hand which displays instantaneous positioning relative to the seasons.

The invention relates to a mechanism for displaying a time period or season for a watch which is simple and economical.

There is meant by time period, a period of a duration less than one year, which belongs to an annual cycle, such as a month, two months, three months, four months, six months, or similar.

More particularly but in a non-limiting manner, the invention is illustrated and explained in the case of a season display.

The invention relates to a mechanism for displaying a time period or season 10, which is provided in order to cooperate with a timepiece movement 200, and comprises an input driving wheel 40, provided in order to cooperate with a wheel of the movement 200, a wheel for hours or similar, as standard.

This mechanism for displaying a time period or season 10 comprises a first wheel 5, at the bottom in the Figures. More particularly but in a non-limiting manner, this first wheel 5 is provided in order to turn once in thirty-one days for displaying a day of the month.

The mechanism 10 comprises a second wheel 6, at the top in the Figures, for displaying another time period or season.

According to the invention, the second wheel 6 turns more quickly than the first wheel 5, for displaying the time period or season. And this second wheel 6 is provided in order to be displaced from the first wheel 5, at the rate of one turn in a period of time between 340 days and 380 days. More particularly, the second wheel 6 is provided in order to be displaced from the first wheel 5, at the rate of one turn per year, or by one turn per 372 days, or by one turn for another duration according to the chosen mechanism and desired displays. For example, a watch for displaying a lunar month can comprise a second wheel 6 which is provided to be displaced by one turn in a period of time between 348 and 377 days, corresponding respectively to 12 or 13 lunar months.

The invention is illustrated for an advantageous application where the first wheel 5 allows display of a day of the month, and where the second wheel 6 allows positioning in the centre of the current year, in particular with respect to the season.

More particularly, with the particular arrangement of the wheelwork described hereafter, the second wheel 6 is displaced by one turn every twelve turns of the first wheel 5.

More particularly, and as illustrated, the second wheel 6 is coaxial with the first wheel 5.

The mechanism 10 comprises a dial 7 with a display scale 70, and the first wheel 5 bears a display or a hand 50 which is provided in order to cooperate with this display scale 70. In the illustrated variant, the dial comprises an aperture 71 which is provided in order to make the upper surface of the second wheel 6 visible.

Advantageously, this display or this hand 50 comprises an opening 59 which provides an aperture for displaying a time period or season, symbolised on the surface of the second wheel 6, which comprises a representation of all successive time periods or respectively of all successive seasons.

The kinematics according to the invention are extremely simple, comprise few components and are of a low total thickness, because of the two levels only which the mechanism 10 occupies.

The input driving wheel 40 is provided in order to be driven by the movement 200 or can be part of this movement, and is provided in order to drive each day, directly or indirectly, a starwheel 44 by one step, in opposition to a starwheel catch 45 and/or a starwheel spring 46.

In an illustrated, non-limiting variant, using the existing components of a mechanism for displaying the day of the month, the driving wheel 40 drives a cam 41 which is provided in order to drive, in opposition to a first catch 43, a driving lever 42 so as to induce pivoting of the starwheel 44 by the value of one step.

The mechanism 10 according to the invention is easy to correct, both at the level of the first wheel 5 and of the second wheel 6.

For positional correction of the first wheel 5, in particular for a correction of the end of the month of a day of the month, the mechanism 10 advantageously comprises a corrector lever 47 which is provided in order to be operated by a user, in opposition to a second catch 48, in order to induce pivoting of the driving lever 42 so as to make the starwheel 44 pivot by one step.

The mechanism 10 comprises a first pinion 51 which is driven directly by the starwheel 44 and meshes with the first wheel 5, and comprises a second pinion 61 which is driven by the starwheel 44 or even directly in a non-illustrated variant, or even as visible in the Figures by means of friction 62, and which meshes with the second wheel 6. In FIG. 2, a washer 49 driven onto a shaft part of the starwheel 44 maintains the bearing thereof by friction 62.

In this preferred variant, illustrated by the Figures, the second pinion 61 is driven by the starwheel 44 by means of friction 62, and the mechanism 10 comprises a corrector intermediate wheel 60 which is provided in order to be controlled by a push button or by a rod of the movement 200. This corrector intermediate wheel 60 is provided in order to mesh, either permanently or during a correction movement, with the second wheel, and is provided in order to drive this second wheel 6 in opposition to the friction 62. This correction of the second wheel 6 is therefore very easy to achieve.

In particular, in the variant illustrated by the Figures, the first pinion 51, the second pinion 61 and the starwheel 44 are coaxial.

In particular, in the variant illustrated in the Figures, the starwheel 44 comprises twelve teeth, and the step, by which an advance is made during each operation, corresponds to one tooth, the first pinion 51 comprises twelve teeth, the second pinion 61 comprises thirteen teeth, and the first wheel 5 and the second wheel 6 each comprise thirty-one teeth. Thus the first wheel 5 and the second wheel 6 are displaced exactly by one turn every 372 days.

The assembly of the mechanism 10 is easy to mount on a plate 30, or on an additional bridge.

The invention also relates to a timepiece movement 200 comprising such a mechanism for displaying a time period or season 10, and comprising an hour wheel which is provided in order to drive or to constitute the driving wheel 40.

More particularly, this movement 200 comprises a rod 210 for winding-up and correction, and this rod 210 is provided in order to control the correction of the time period or season by means of a train of intermediate wheels which act on the corrector intermediate wheel 60.

More particularly, this movement 200 comprises a push button 220 which is provided in order to control the correction of the position of the first wheel 5 by pressing on the corrector lever 47.

The invention also relates to a watch 300 comprising such a timepiece movement 200.

What is claimed is:

1. A mechanism for displaying a time period or season which is provided in order to cooperate with a timepiece movement, and comprising a first wheel and a second wheel for displaying a time period or season, said second wheel turning more quickly than said first wheel, wherein said first wheel is provided in order to turn once in thirty-one days for displaying a day of the month, wherein said second wheel is provided in order to be displaced from said first wheel, at the rate of one turn more than said first wheel in a period of time between 340 days and 380 days, wherein said mechanism comprises a driving wheel which is provided in order to be driven by said movement and in order to drive each day, directly or indirectly, a starwheel by one step, in opposition to a starwheel catch and/or a starwheel spring, and wherein said mechanism comprises a first pinion which is driven directly by said starwheel and meshes with said first wheel, and a second pinion which is driven by said starwheel, directly or by means of friction, and meshes with said second wheel.

2. The mechanism for displaying a time period or season according to claim 1, wherein said second wheel is displaced by one more turn per year or every 372 days.

3. The mechanism for displaying a time period or season according to claim 1, wherein said second wheel is displaced by one more turn every twelve turns of said first wheel.

4. The mechanism for displaying a time period or season according to claim 1, wherein said second wheel is coaxial with said first wheel.

5. The mechanism for displaying a time period or season according to claim 1, wherein said mechanism comprises a dial with a display scale, and said first wheel bears a display or a hand which is provided in order to cooperate with said display scale.

6. The mechanism for displaying a time period or season according to claim 5, wherein said display or said hand comprises an opening which provides an aperture for displaying a time period or season, symbolised on the surface of said second wheel, which comprises a representation of all successive time periods or respectively of all successive seasons.

7. The mechanism for displaying a time period or season according to claim 1, wherein said driving wheel drives a cam which is provided in order to drive, in opposition to a first catch, a driving lever so as to induce pivoting of said starwheel by said step.

8. A timepiece movement comprising a mechanism for displaying a time period or season according to claim 7, and comprising a push button, wherein said push button is provided in order to control correction of the position of said first wheel by pressing on said corrector lever.

9. The mechanism for displaying a time period or season according to claim 7, wherein said mechanism comprises a corrector lever which is provided in order to be operated by a user, in opposition to a second catch, in order to induce pivoting of said driving lever so as to make said starwheel pivot by one said step.

10. The mechanism for displaying a time period or season according to claim 1, wherein said second pinion is driven by said starwheel by means of friction, and said mechanism comprises a corrector intermediate wheel which is provided in order to be controlled by a push button or by a rod of said movement, and meshes with said second wheel and is provided in order to drive it in opposition to said friction.

11. A timepiece movement comprising a mechanism for displaying a time period or season according to claim 10, and comprising a rod for winding-up and correction, wherein said rod is provided in order to control the correction of the time period or season by means of a train of intermediate wheels which act on said corrector intermediate wheel.

12. The mechanism for displaying a time period or season according to claim 1, wherein said first pinion, said second pinion and said starwheel are coaxial.

13. The mechanism for displaying a time period or season according to claim 1, wherein said starwheel comprises twelve teeth and said step corresponds to one tooth, said first pinion comprises twelve teeth, said second pinion comprises thirteen teeth, and said first wheel and said second wheel each comprise thirty-one teeth.

14. A timepiece movement comprising a mechanism for displaying a time period or season according to claim 1, and comprising an hour wheel which is provided in order to drive or to constitute said driving wheel.

15. A watch comprising a timepiece movement according to claim 1.

* * * * *